United States Patent [19]

Loveday et al.

[11] Patent Number: 4,666,212

[45] Date of Patent: May 19, 1987

[54] METAL VALUE RECOVERY

[75] Inventors: Brian K. Loveday; James A. J. Tumily; William D. Douglas, all of Transvaal, South Africa

[73] Assignee: Crucible S.A., Luxembourg

[21] Appl. No.: 744,131

[22] Filed: Jun. 12, 1985

[30] Foreign Application Priority Data

Jun. 15, 1984 [ZA] South Africa ..... 84/4546

[51] Int. Cl.[4] ..... E21B 43/28

[52] U.S. Cl. ..... 299/5; 299/7; 299/8; 299/16

[58] Field of Search ..... 299/3, 4, 5, 6, 7, 8, 299/16; 423/23, 24, 27, 29, 32, 36, 37; 166/307

[56] References Cited

U.S. PATENT DOCUMENTS

| | | | |
|---|---|---|---|
| 4,051,026 | 9/1977 | Cremers et al. | 423/24 |
| 4,241,026 | 12/1980 | Yan | 299/5 X |
| 4,243,638 | 1/1981 | Jackovitz et al. | 299/5 X |
| 4,489,984 | 12/1984 | Savins | 299/5 |
| 4,526,615 | 7/1985 | Johnson | 299/5 X |

*Primary Examiner*—Stephen J. Novosad
*Assistant Examiner*—Thomas J. Odan
*Attorney, Agent, or Firm*—Scully, Scott, Murphy & Presser

[57] ABSTRACT

Metal values, particularly precious metal values, are recovered from fines on a footwall and in the fissures and cracks therein by passing a solution capable of solubilizing the metal values across the footwall. The metal values are preferably adsorbed on to a suitable support such as activated carbon underground and then the support, having the metal values adsorbed thereon, transported to the surface for further processing.

2 Claims, No Drawings

METAL VALUE RECOVERY

BACKGROUND OF THE INVENTION

This invention relates to the recovery of metal values.

In many mining operations, the reef in the stope face is blasted or otherwise detached from the stope face and the broken ore thereafter transported to the surface for further processing and recovery of the metal values contained therein. In any operation of this nature a great deal of particulate fines remain on the footwall and in the fissures and cracks within the footwall. These particulate fines contain substantial quantities of the valuable metals being mined, particularly in the case of gold mining, where the small dense particles of gold segregate when the ore is moved. Some of these particle fines are collected by sweeping or by use of suction means. However this is not always possible in old abandoned stopes.

SUMMARY OF THE INVENTION

According to the present invention, there is provided a method of recovering metal values from a particulate ore on or in the footwall of the mining excavation, including the steps of contacting the particulate ore with a liquid capable of solubilising the metal values, collecting the liquid containing the solubilised metal values and removing the metal values from the liquid. The method of the invention thus provides an in situ method for recovering metal values from fines remaining on a footwall and in the cracks and fissures thereof.

DESCRIPTION OF PREFERRED EMBODIMENTS

The liquid will generally be caused to flow across the footwall such that it penetrates fissures and cracks in the footwall. The liquid may be sprayed or otherwise run across the footwall. Spraying is preferred.

It is desirable that the solubilising liquid contains as high a metal value concentration as possible before it is processed further to remove the metal values. Thus, according to a preferred form of the invention, the liquid containing the solubilised metal values is again contacted with the particulate ore on or in the footwall, and this operation repeated until a desired concentration of the metal values in the liquid has been obtained.

The liquid containing the solubilised metal values may be transported out of the mine for further processing by methods known in the art to remove the metal values therefrom. However, it is preferred that the metal values are captured on to a transportable solid support while still underground and the support then transported out of the mining excavation for further processing and recovery of the metal values. Examples of suitable solid supports are activated carbon and ion exchange resins.

The solubilising liquid will, of course, be chosen to minimise contamination of the water in the mine and enviromental damage and pollution.

Contact between the solubilising liquid and the particulate ore preferably takes place under ambient underground conditions.

The method of the invention has application to the recovery of precious metal, particularly gold and silver.

When the method of the invention is applied to the recovery of gold or silver values, examples of suitable solubilising liquids are the following:

1. An acidic thiourea solution optionally containing ferric ions. Typically the solution has a pH of 1 to 3 and a concentration of 0.2 to 1 g per liter of thiourea. The ferric ions, when provided may have a concentration of 0.75 g/l and the solution may also contain 1.3 g/l sodium sulphite. An acidic thiourea solution is the preferred solubilising liquid.

2. A cyanide leach solution having an alkaline pH. The cyanide concentration is typically about 0.2 g per liter and the pH of the solution is typically 10.5. This solubilising liquid is not preferred because of the toxicity of the leach solution.

3. Acidic chlorine water. An example of such a solution is chlorine water containing about 6 g/l $Cl_2$ and having a pH of 1 to 2. An alternative such solution is one containing 5 g/l calcium hypochlorite and acidified with sulphuric acid to a pH of 5.

4. A thiosulphate solution. Such a solution may contain 12 to 25 percent by weight ammonium thiosulphate, and a small concentration of sulphite. Typical sulphite concentrations are of the order of 0.05 percent. The solution will typically have a pH of 8 to 10 and may also contain copper ions in a concentration of 1 to 4 g per liter.

The invention has greatest application to the recovery of precious metal values from fines on or in the footwall of a mining excavation. The solubilising liquid is caused to pass over the footwall and in so doing will come into contact with the fines both on the surface of the footwall and in the fissures or cracks. It is preferred that the solubilising liquid is caused to run down the footwall and into a suitable collecting zone from where it is re-circulated to the footwall. This is repeated until a desired concentration of metal values in the liquid has been obtained when it is passed through a bed of a solid support to remove the metal values from the liquid. The lean liquid exiting from the bed of solid support may be circulated back to the footwall. The collecting zones may be provided by suitably located sumps in gulleys, box holes or cross cuts.

The invention is further illustrated by the following two examples. In both examples the solubilising liquid (leaching solution) used was an acidic thiourea solution, as described above.

EXAMPLE 1

On a mine on the Witwatersrand a worked out area was selected and a wall built in a gulley to provide a sump for spraying the adjacent stope. A pump and spray system was installed for leaching the stope. Prior to spraying the stope the leaching solution was circulated in the sump to determine the quantity of gold available to leaching in the gulley itself. After 5 days of circulation the gold value in solution had built up to a value of 13.17 g/t of solution. The solution was then passed through a column of activated carbon to adsorb the gold values and so strip the solution.

EXAMPLE 2

On another mine on the Witwatersrand a second worked out area was selected for leaching trials. A sump was built, and spraying of the footwall of the stope was commenced. The concentration of gold in solution increased slowly over a period of 38 days to a maximum of 3.4 g/t gold in the solution was pump through a column of activated carbon to adsorb the gold values and so strip the solution.

In both examples, effective recovery of gold values from the fines on the footwall was achieved.

We claim:

1. A method of recovering metal values from a particulate ore on or in the footwall of a mining excavation, including the steps of contacting the particulate ore with a solubilizing liquid comprising an acidic thiourea solution capable of solubilizing the metal values wherein the liquid is caused to flow across the footwall such that it penetrates fissures and cracks present in the footwall, collecting the liquid containing the solubilized metal values and removing the metal values from the liquid, said thiourea solution having a concentration of 0.2 to 1 g per liter and a pH of 1 to 3.

2. A method according to claim 1 wherein the thiourea solution contains ferric ions.

* * * * *